US010927422B2

(12) United States Patent
Fanning

(10) Patent No.: US 10,927,422 B2
(45) Date of Patent: Feb. 23, 2021

(54) STACKED CONTINUOUS VACUUM PAN SYSTEM AND METHOD

(71) Applicant: Sugar Technology International, Plano, TX (US)

(72) Inventor: Mark Quenton Fanning, Plano, TX (US)

(73) Assignee: SUGAR TECHNOLOGY INTERNATIONAL, Plano, TX (US)

( * ) Notice: Subject to any disclaimer, the term of this patent is extended or adjusted under 35 U.S.C. 154(b) by 0 days.

(21) Appl. No.: 16/334,279

(22) PCT Filed: Sep. 21, 2016

(86) PCT No.: PCT/US2016/052754

§ 371 (c)(1),
(2) Date: Mar. 18, 2019

(87) PCT Pub. No.: WO2018/056961

PCT Pub. Date: Mar. 29, 2018

(65) Prior Publication Data

US 2019/0218630 A1 Jul. 18, 2019

(51) Int. Cl.

| | |
|---|---|
| ***C13B 25/02*** | (2011.01) |
| ***C13B 25/04*** | (2011.01) |
| ***C13B 30/02*** | (2011.01) |
| ***C13B 25/00*** | (2011.01) |

(52) U.S. Cl.

CPC ..... *C13B 25/02* (2013.01); *C13B 25/00* (2013.01); *C13B 25/001* (2013.01); *C13B 25/04* (2013.01); *C13B 30/022* (2013.01)

(58) Field of Classification Search

CPC ..... C13B 25/02; C13B 25/00; C13B 25/04; C13B 25/001; C13B 30/02; C13B 30/022; C13K 1/00; C13K 1/08; C13K 13/00; B01D 1/0088; B01D 1/22; B01D 1/26; B01D 1/30

USPC ..... 159/17.1, 17.4, 18, 32; 127/2, 9, 42, 127/46.1

See application file for complete search history.

(56) References Cited

U.S. PATENT DOCUMENTS 1,476,331 A * 12/1923 Godfrey, Sr. ..... B01D 1/12 159/25.2
1,785,530 A * 12/1930 Ray ..... B01D 1/00 127/61
2,258,704 A * 10/1941 Hamill ..... C13B 25/001 159/27.1

(Continued)

FOREIGN PATENT DOCUMENTS

CN 202482331 10/2012
WO WO 2008/015019 3/2008

OTHER PUBLICATIONS

PCT Search Report and Written Opinion (dated Mar. 24, 2017).

*Primary Examiner* — Joseph W Drodge
(74) *Attorney, Agent, or Firm* — Kirby Drake

(57) ABSTRACT

A stacked continuous vacuum pan (SCVP) system and method may be provided wherein the SCVP includes at least three modules mounted on separate floors in a stacked formation. Each module includes a horizontal shell and a vertical calandria mounted along the horizontal shell. The calandria may be a honeycomb or swarm calandria. The SCVP system may operate as a single unit while allowing an individual module to be taken offline without disrupting use of the SCVP system.

20 Claims, 5 Drawing Sheets

(56) References Cited

U.S. PATENT DOCUMENTS

| | | | | |
|---|---|---|---|---|
| 2,312,407 | A * | 3/1943 | Hamill | C13B 25/001 159/27.1 |
| 2,326,619 | A * | 8/1943 | Carreras | C13B 25/001 159/27.1 |
| 2,355,397 | A * | 8/1944 | Scharnberg | B01F 7/22 159/25.2 |
| 3,490,947 | A | 1/1970 | Grieselhuber | |
| 4,059,460 | A * | 11/1977 | Schollmeier | C13K 1/10 127/29 |
| 4,120,745 | A * | 10/1978 | Gotthard | B01D 9/0063 159/27.3 |
| 6,691,708 | B2 * | 2/2004 | Kwok | A61M 16/06 128/201.24 |
| 7,972,445 | B2 * | 7/2011 | Singh | C13B 25/02 127/16 |
| 8,277,562 | B2 * | 10/2012 | Love | C13B 30/022 127/15 |
| 2002/0117268 | A1 * | 8/2002 | Schorn | B01D 9/0022 159/27.5 |
| 2004/0050503 | A1 * | 3/2004 | Vallejo-Martinez | B01D 1/22 159/22 |
| 2009/0056706 | A1 | 3/2009 | Singh et al. | |

* cited by examiner

STACKED CONTINUOUS VACUUM PAN SYSTEM AND METHOD

FIELD OF THE DISCLOSURE

The present disclosure generally relates to continuous crystallization of sugar, and more particularly to continuous crystallization of sugar using a stacked continuous vacuum pan system and method.

BACKGROUND

Sugar typically comes from sugarcane or sugar beets. Once harvested, the sugar is extracted and then undergoes purification and clarification followed by evaporation. Crystallization is the next step in the sugar manufacturing process. It involves the nucleation and growth of sugar crystals. The syrup is evaporated until saturated with sugar. Once the saturation point has been exceeded, small grains of sugar are added to the pan, or "strike." These small grains, called "seed," serve as nuclei for the formation of sugar crystals. Additional syrup is added to the strike and evaporated so that the original crystals that were formed are allowed to grow in size. The growth of the crystals continues until the pan is full.

This crystallization process typically takes place under vacuum and involves the simultaneous processes of mass transfer and evaporation. Vacuum is used to keep the temperature at a low enough level to minimize color formation as well as the inversion/degradation of sucrose. Crystallization has typically been carried out in batch vacuum pans, although more recently, continuous systems have been introduced. Nevertheless, the process of initiating crystallization is still carried out on a batch basis. When sucrose concentration reaches the desired level, the dense mixture of syrup and sugar crystals, called massecuite, is discharged into large containers, known as crystallizers. Crystallization continues in the crystallizers as the massecuite is slowly stirred and cooled. Massecuite then flows into centrifugals, where molasses is separated from the raw sugar by centrifugal force. The sugar crystals may then be dried and packaged in solid and/or liquid form.

Encrustation is a problem that sometimes occurs with high-grade massecuite continuous pans. Encrustation can result from accumulations on exposed surfaces above the boiling level of the massecuite, and problems can occur when accumulations break off and get into the system. Encrustation also may result from a build-up on heating surfaces, and this may lead to reduction in heat transfer rates. These types of encrustation can lead to impurities in the end product, and thus, are of great concern for high-grade massecuites. There are several places where encrustation can occur within the system, including but not limited to, the partition plates, the tube walls, and the bottom section local to the downtake. When encrustation occurs in one or more of these places, the system may need to be shut down and boiled-out to remove the encrustation.

SUMMARY

Embodiments of the present disclosure may provide a stacked continuous vacuum pan system comprising at least three horizontal modules, each module having a horizontal shell and a vertical calandria mounted along the horizontal shell, wherein each of the at least three horizontal modules may be mounted on a separate floor of the system in a stacked configuration and the system may operate as a single unit such that syrup, molasses and product massecuite may flow continuously down through the at least three horizontal modules. The vertical calandria may be formed of stainless steel. The vertical calandria may be a single bank of vertical tubes within a housing, wherein the vertical tubes may be sealed in a polygonal formation at the ends. The vertical calandria may be formed of a plurality of superimposed interspaced banks of vertical tubes, wherein the vertical tubes may be sealed in a polygonal formation at the ends. Each of the at least three horizontal modules may have at least two compartments and massecuite may flow from one compartment to another compartment. An internal surface of the horizontal shell of each of the at least three horizontal modules may have a non-stick surface, which may be polytetrafluoroethylene (PTFE). The vertical calandria may provide for up to approximately 25% greater heating surface than a tubular calandria. Each of the at least three horizontal modules may be separately removable from the system to be cleaned while continuing a boiling process at a reduced rate through remaining ones of the at least three horizontal modules. The system may be suitable for use with A massecuite, B massecuite, C massecuite, raw massecuite, refined massecuite and high-purity, high-viscosity massecuite. The system may be used for both recovery and refinery operations in cane and beet sugar refineries. The shape of the system may provide a smooth massecuite flow-path without stagnant areas or short circuiting.

Another embodiment of the present disclosure may provide a stacked continuous vacuum pan method comprising receiving a seed in a first horizontal module; processing massecuite in the first horizontal module; flowing massecuite from the first horizontal module to a second horizontal module; processing massecuite in the second horizontal module; and flowing massecuite from the second horizontal module to a third horizontal module, wherein each of the first horizontal module, the second horizontal module and the third horizontal module may have a horizontal shell and a vertical calandria mounted along the horizontal shell, and wherein the first horizontal module, the second horizontal module and the third horizontal module may be formed in a stacked configuration with each module mounted on a separate floor to allow massecuite to flow continuously down through the modules. Each of the first horizontal module, the second horizontal module and the third horizontal module may have at least two cells where the processing steps occur. The vertical calandria may have a honeycomb structure. The method also may comprise bypassing one of the first horizontal module, the second horizontal module and the third horizontal module while continuing a boiling process at a reduced rate through the other two horizontal modules.

Further embodiments of the present disclosure may provide a stacked continuous vacuum pan system comprising at least three horizontal modules, each module having a horizontal shell and a honeycomb-shaped calandria mounted along the horizontal shell, wherein each of the at least three horizontal modules may be mounted on a separate floor of the system in a stacked configuration such that massecuite may flow down through the stacked configuration, and wherein each of the at least three horizontal modules may be separately by-passable such that the system may be capable of being continuously used at a reduced rate through the remaining horizontal modules. Each of the at least three horizontal modules may have at least two cells through which massecuite flows. An internal surface of the horizontal shell of each of the at least three horizontal modules may have a non-stick surface. The shape of the system may provide a smooth massecuite flow-path without stagnant areas or short circuiting.

BRIEF DESCRIPTION OF THE DRAWINGS

For a more complete understanding of this disclosure, reference is now made to the following description, taken in conjunction with the accompanying drawings, in which.

DETAILED DESCRIPTION

In constructing heat exchangers, the aim is to achieve maximum performance in as small of a footprint as is possible. This may be done through providing a maximum amount of heating surface within the minimum possible footprint. A stacked continuous vacuum pan (SCVP) system and method according to embodiments of the present disclosure may provide for a vertical outdoor installation within such a compact structure.

Figure 3:
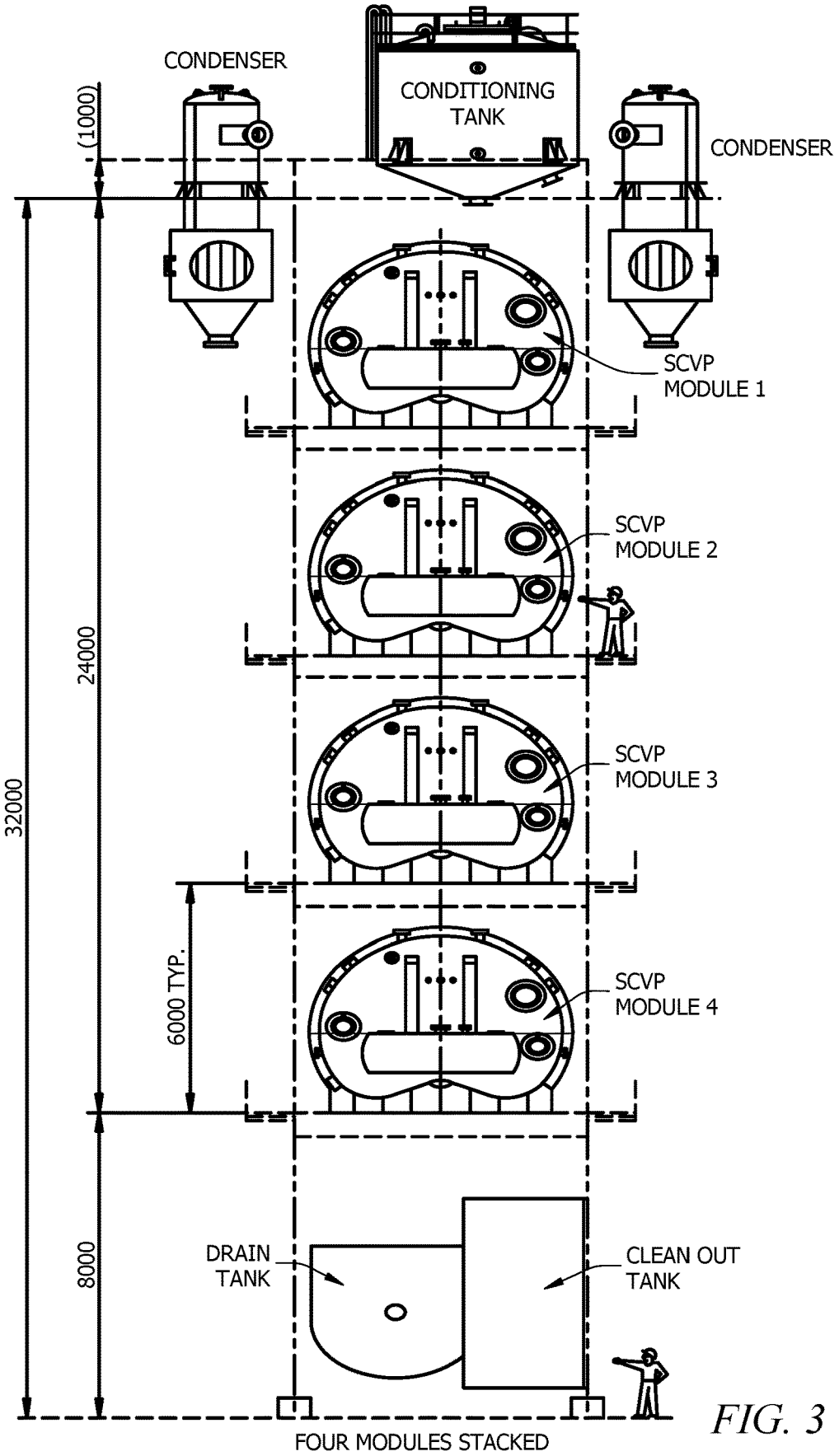
FIG. 3 depicts a side view of a four-module stacked SCVP system according to an embodiment of the present disclosure.
Figure 4:
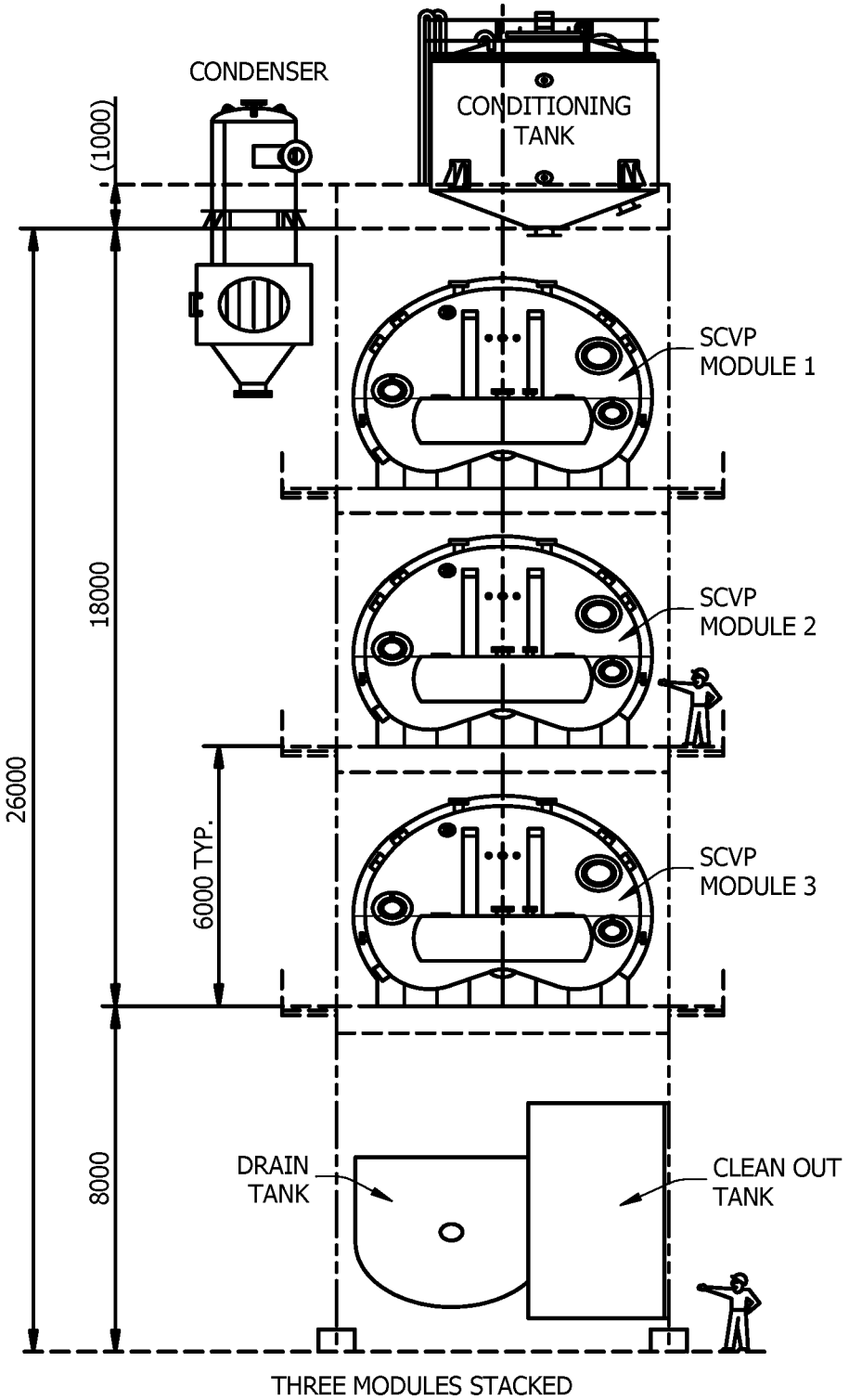
FIG. 4 depicts a side view of a three-module SCVP system according to embodiment of the present disclosure.
Figure 5:
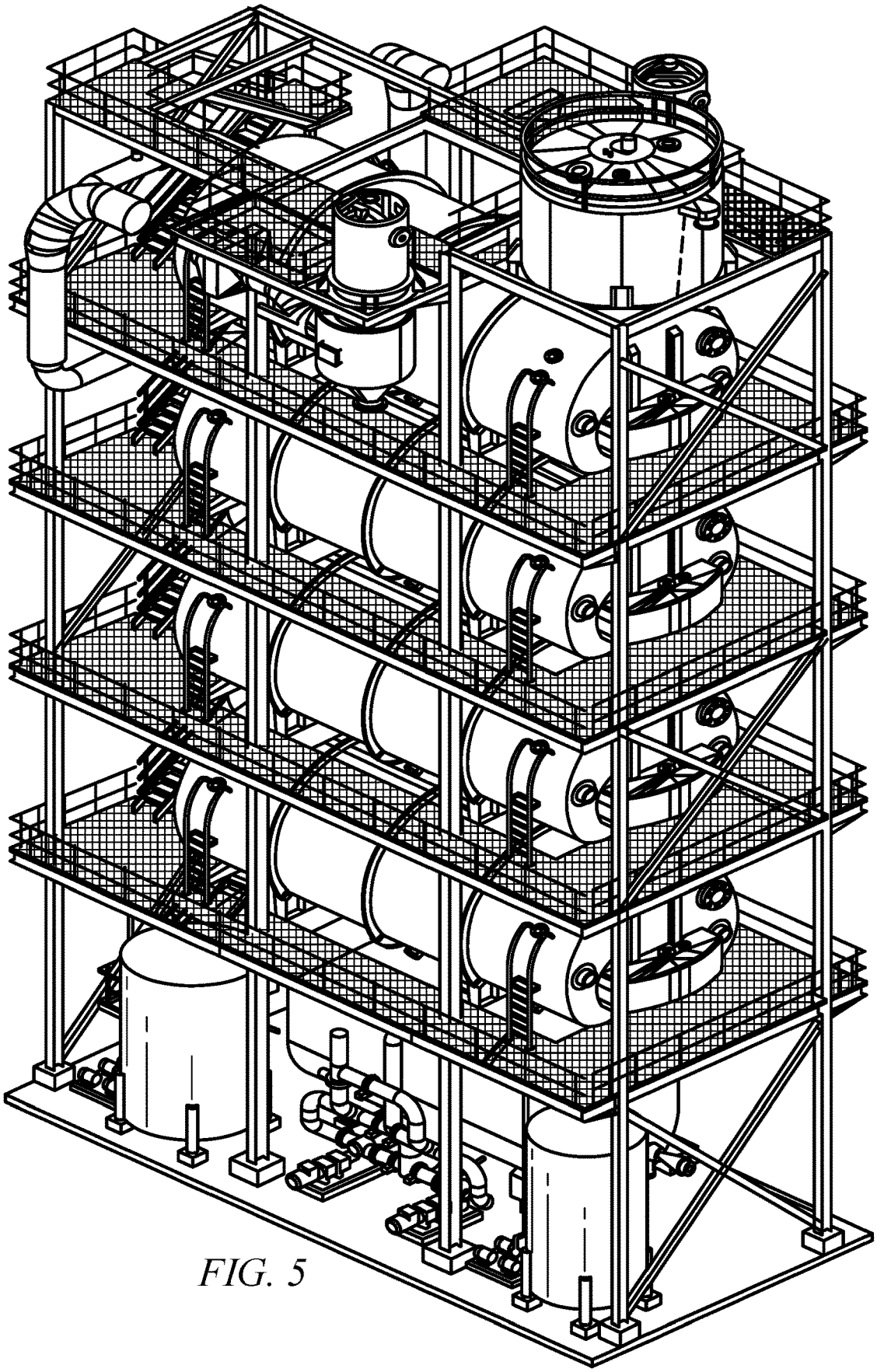
FIG. 5 depicts a perspective view of an SCVP system according to an embodiment of the present disclosure.

Embodiments of the present disclosure may provide an SCVP system that may include at least three horizontal-type units, that may be referred to herein as modules. In some embodiments of the present disclosure, there may be three or four modules within the SCVP system. For example, FIG. 3 depicts a side view of a four-module stacked SCVP system according to an embodiment of the present disclosure, and FIG. 4 depicts a side view of a three-module SCVP system according to embodiment of the present disclosure. It should be appreciated, however, that there may be more or fewer modules utilized within the system without departing from the present disclosure. The modules may be mounted on separate floors, such as depicted in the SCVP system of FIG. 5, with a first module mounted below a second module and so forth, until all of the modules are stacked vertically on top of one another.

Figure 1:
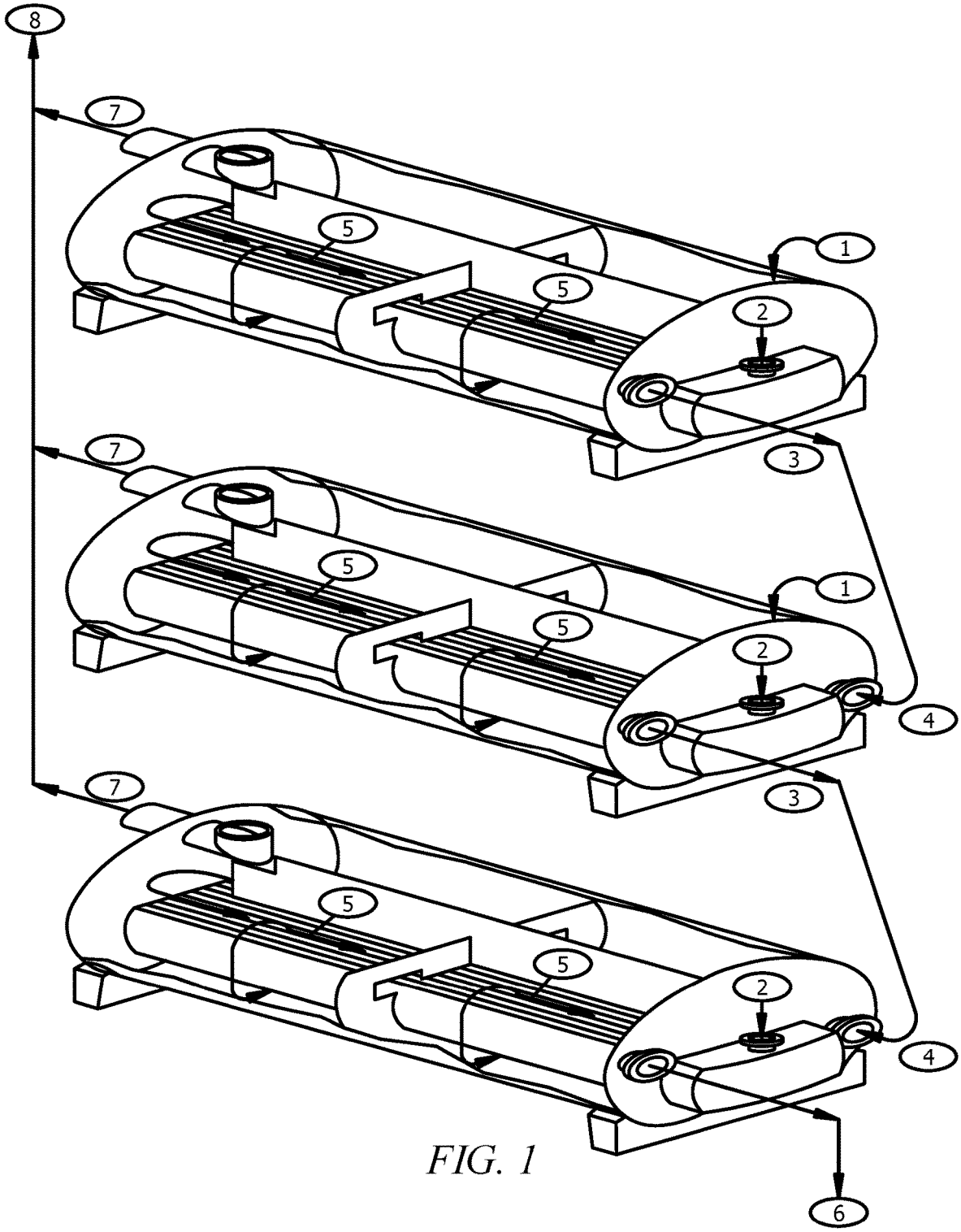
FIG. 1 depicts an SCVP system according to an embodiment of the present disclosure.

FIG. 1 depicts an SCVP system according to an embodiment of the present disclosure. This SCVP system includes three modules positioned in a stacked formation. Each module of a SCVP system according to embodiments of the present disclosure may be formed of a cylindrical-type casing having a length that is greater than its diameter. Each module may have a horizontal longitudinal axis. It should be appreciated that the internal surface of the shell may be formed having a non-stick surface. Use of a non-stick surface may lead to reduced encrustation of the system during the crystallization process. The non-stick surface may be formed of a material, such as polytetrafluoroethylene (PTFE); however, another similar non-stick coating may be utilized without departing from the present disclosure. By having a non-stick surface, this may aid in maintaining good circulation and constant flow through the SCVP system at all times.

FIG. 1 depicts a stacked continuous vacuum pan method using a SCVP system according to an embodiment of the present disclosure. In this embodiment, seed 1 enters a first module of the SVCP system. Vapor 2 may form in each of the modules forming the SCVP system. Massecuite leaving the first module 3 then may enter a second module 4. This process (steps 3 and 4) may be repeated with massecuite leaving the second module and then entering a third module as depicted in FIG. 1. While only three modules are depicted in FIG. 1, it should be appreciated that more or fewer modules may be present without departing from the present disclosure.

It should be appreciated that a module may be taken off-line (as described in more detail below) but the SCVP may continue operation. For example, the second module of FIG. 1 may be taken off-line. In that instance, massecuite leaving the first module may enter the third module instead of the second module.

Massecuite may be processed within one or more cells of a module 5. This type of processing may occur in each of the cells within each of the modules forming the SCVP system as reflected in FIG. 1. Vapor may leave each of the modules 7, and then the vapor may be circulated to a condenser 8.

As previously discussed, crystallization typically takes place under vacuum and involves the simultaneous processes of mass transfer and evaporation. Modules, such as those depicted in FIG. 1, include a calandria that may be mounted along the shell axis of a module of the SCVP system. A calandria is a tubular or plate-heating element in a vacuum pan or evaporator vessel. In embodiments of the present disclosure, each module may include a vertical calandria that may be mounted along the horizontal shell of the module. The calandria may be formed in a tube-like shape (described in more detail below) and may be formed of a solid material, such as stainless steel, in some embodiments of the present disclosure. However, it should be appreciated that the calandria may be formed of other materials without departing from the present disclosure. Vapor or steam may collect on the outside of the tubes, while raw massecuite may naturally boil in the interior portion of the tubes.

Figure 2A:
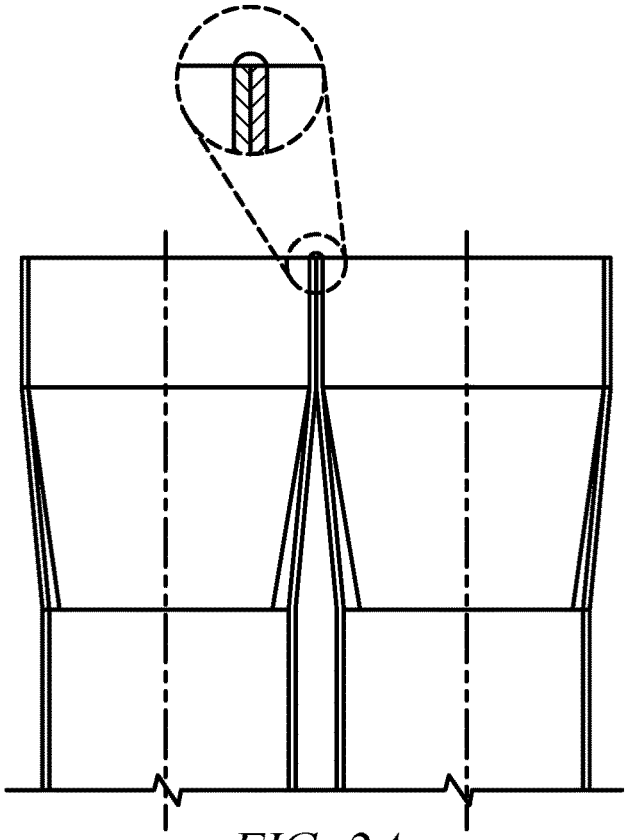
FIGS. 2A and 2B depict a honeycomb/swarm calandria for an SCVP system according to an embodiment of the present disclosure.
Figure 2B:
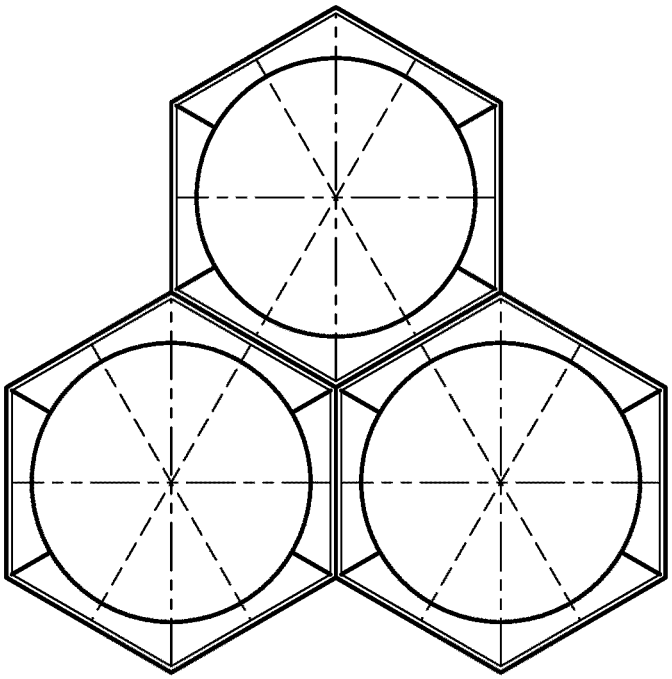

In embodiments of the present disclosure, a honeycomb or swarm calandria, having a structure such as that depicted in FIGS. 2A and 2B, may be utilized to reduce dead zones that are present in a typical calandria. By reducing the dead zones, this may lead to less local overheating when compared to a traditional tubesheet having dead zone surfaces. As depicted in FIG. 2A, the calandria tubular heating elements are forged together to a polygon-type shape at the ends and welded or otherwise fastened directly to each other without the use of a tube plate.

Use of a honeycomb or swarm calandria may provide a means to maximize the heating surface within a specified amount of area within the SCVP system. A calandria according to embodiments of the present disclosure may provide for up to approximately 25% greater heating surface as compared to a tubular calandria. Use of a honeycomb calandria according to embodiments of the present disclosure may provide benefits to the crystallization process in that it leaves no space for settling sugar, as there is approximately 75% less area in the upper side of a honeycomb calandria as compared to a tubular calandria.

As the structural design/make-up of a honeycomb or swarm calandria is compact, particularly insofar as the design eliminates the top and bottom tube sheets, the overall dimensions of an SCVP system may be reduced while improving flow conditions through the SCVP system. A honeycomb or swarm calandria according to embodiments of the present disclosure also may provide greater structural integrity, lower maintenance costs and long life, and lower installation costs by eliminating the field tube expansion procedure. In some embodiments of the present disclosure, honeycomb cells for a calandria come ready to be installed.

An SCVP system according to embodiments of the present disclosure may include a lower hydrostatic head, which may contribute to further improved massecuite circulation and exhaustion, as it does not require the use of a mechanical stirrer or additional electrical load. Further, this may help to maintain a constant massecuite circulation flow, even at a lower heating vapor pressure.

The modules forming a system according to embodiments of the present disclosure may be operated as a single unit. This means that syrup or molasses as well as the product massecuite may flow continuously down through the modules, generally starting with the module positioned on the highest floor of the system. However, as described in more detail below, there may be some embodiments wherein the flow may not begin with the module positioned on the highest floor of the system, such as when that module has been taken offline for cleaning. Crystal growth may increase from module to module.

A SCVP system and method according to embodiments of the present disclosure may maximize availability of the system insofar as one module of the system may be cleaned "on the run" while continuing the boiling process at a reduced rate through the remaining modules. This in turn may reduce the recirculation of materials in the boiling house and also may reduce the quantity of pan wash water to be handled after a boiling out.

Further, in order to minimize encrustation—and the resultant shutdowns that can occur—modules in a SCVP system according to embodiments of the present disclosure may be sub-divided into multi-celled units to ensure good crystal distribution. The modules may then be arranged in the stacked format to allow the massecuite flow to cascade from one module to the next module in series. As depicted in FIG. 1, a module may be divided into two cells or compartments; however, it should be appreciated that a module may be divided into more than two cells or compartments without departing from the present disclosure. In operation, the massecuite may flow from one cell or compartment to the next without the need to specifically pump massecuite to the various cells or compartments within a module. The pipe work associated with the SCVP system may be arranged so that, at any time, one module may be bypassed so that it may be cleaned out (i.e., to address encrustation) without the rest of the SCVP system having to be taken off-line.

It should be appreciated that the SCVP system and method according to embodiments of the present disclosure may provide having sufficient flexibility to be suitable for use with different grades of sugar syrup. The SCVP system and method according to embodiments of the present disclosure may be suitable for all types of massecuite, including but not limited to, A, B, C, raw and refined. This may include high purity, high-viscosity massecuites. It also should be appreciated that in cane and beet sugar refineries, the SCVP system and method may be used for both recovery house (raw sugar) and refining operations without departing from the present disclosure.

Use of a SCVP system and method according to embodiments of the present disclosure may reduce or even eliminate problems that often occur with batch-type crystallization. The shape of the SCVP system according to embodiments of the present disclosure may provide a smooth massecuite flow-path without stagnant areas or short circuiting. Other benefits may include maximizing utilization of the physical footprint of a plant (i.e., vertical outdoor installation provided in a compact structure), having a steady demand on services such as steam and power, providing for easier plant control because the conditions remain relatively stable over time, maintaining easier monitoring of process parameters associated with the SCVP system, providing a more consistent product, and enabling the entire operation to be more thermally efficient. Utilization of the SCVP system and method according to embodiments of the present disclosure does not require the use of mechanical stirrers, and accordingly, there is no additional electrical load. Fast-track installation and assembly also may be provided. Capacity may be expandable such that as a factory increases in capacity, additional modules may be added. The system also may provide for high-steam economy with the use of low-temperature vapors and/or re-compression of vapors. An SCVP system according to embodiments of the present disclosure may allow for each module to be operated on a different vapor pressure in a steady state. The system also may enable use of mechanical vapor recompression and/or double-effect evaporation in a vacuum pan. A high-heating surface may therefore be provided in a small footprint.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A stacked continuous vacuum pan system comprising:

at least three horizontal modules, each module having an external horizontal shell and a vertical tubed type calandria mounted inside and along a length of the horizontal length a length of wherein each of the at least three horizontal modules is mounted on a separate floor of the system in a stacked configuration and the system operates as a single unit such that syrup, molasses and product massecuite flow continuously down through the at least three horizontal modules.

2. The stacked continuous vacuum pan system of claim 1 wherein the vertical calandrias are manufactured of stainless steel.

3. The stacked continuous vacuum pan system of claim 1 wherein the vertical calandrias are each a single bank of vertical tubes within a housing, wherein the vertical tubes are sealed in a polygonal formation at the ends.

4. The stacked continuous vacuum pan system of claim 1 wherein the vertical calandrias are each formed of a plurality of superimposed interspaced banks of vertical tubes, wherein the vertical tubes are sealed in a polygonal formation at the ends.

5. The stacked continuous vacuum pan system of claim 1 wherein each of the at least three horizontal modules has at least two compartments and the product massecuite flows from one compartment to another compartment.

6. The stacked continuous vacuum pan system of claim 1 wherein an internal surface of the horizontal shell of each of the at least three horizontal modules has a non-stick surface.

7. The stacked continuous vacuum pan system of claim 6 wherein the non-stick surface is polytetrafluoroethylene (PTFE).

8. The stacked continuous vacuum pan system of claim 1 wherein the vertical calandrias provides for up to approximately 25% greater heating surface than a standard tubular type calandria.

9. The stacked continuous vacuum pan system of claim 1 wherein each of the at least three horizontal modules is separately removable from the system to be cleaned while continuing a massecuite boiling process at a reduced rate, proportionate to the number of removed modules, through remaining ones of the at least three horizontal modules.

10. The stacked continuous vacuum pan system of claim 1 wherein the system is suitable for use with A massecuite, B massecuite, C massecuite, raw massecuite, refined massecuite and high-purity, high-viscosity massecuite.

11. The stacked continuous vacuum pan system of claim 1 wherein the system is useable for both recovery and refinery operations in cane and beet sugar refineries.

12. The stacked continuous vacuum pan system of claim 1 wherein the stacked configuration of the system provides an uninterrupted massecuite flow-path without stagnant areas or short circuiting.

13. A stacked continuous vacuum pan method comprising:

receiving a seed in a first horizontal module;

processing massecuite in the first horizontal module;

flowing massecuite from the first horizontal module to a second horizontal module;

processing massecuite in the second horizontal module; and flowing massecuite from the second horizontal module to a third horizontal module, wherein each of the first horizontal module, the second horizontal module and the third horizontal module has an external horizontal shell and a tubed type vertical calandria mounted inside and along the horizontal shell, and wherein the first horizontal module, the second horizontal module and the third horizontal module are formed in a stacked configuration with each module mounted on a separate floor to allow massecuite to flow continuously down through the modules.

14. The stacked continuous vacuum pan method of claim 13 wherein each of the first horizontal module, the second horizontal module and the third horizontal module has at least two compartments where the processing steps occur.

15. The stacked continuous vacuum pan method of claim 13 wherein the vertical calandrias have a honeycomb structure.

16. The stacked continuous vacuum pan method of claim 13 further comprising:

bypassing one of the first horizontal module, the second horizontal module and the third horizontal module while continuing a massecuite boiling process at a reduced rate, proportionate to the number of removed modules, through the other two horizontal modules.

17. A stacked continuous vacuum pan system comprising:

at least three horizontal modules, each module having an external horizontal shell and a honeycomb-shaped calandria mounted inside and along the horizontal shell, wherein each of the at least three horizontal modules is mounted on a separate floor of the system in a stacked configuration such that massecuite flows down through the stacked configuration, and wherein each of the at least three horizontal modules is separately by-passable such that the system is capable of being continuously used at a reduced rate through the remaining horizontal modules.

18. The stacked continuous vacuum pan system of claim 17 wherein each of the at least three horizontal modules has at least two compartments through which massecuite flows.

19. The stacked continuous vacuum pan system of claim 17 wherein an internal surface of the horizontal shell of each of the at least three horizontal modules has a non-stick surface.

20. The stacked continuous vacuum pan system of claim 17 wherein the stacked configuration of the system provides an uninterrupted massecuite flow-path without stagnant areas or short circuiting.

* * * * *